US006434348B1

(12) United States Patent
Tomizawa

(10) Patent No.: US 6,434,348 B1
(45) Date of Patent: Aug. 13, 2002

(54) IMAGE FORMING APPARATUS WITH SELECTABLE DUAL IMAGE TRANSFERRING MODES HAVING DIFFERENT IMAGE TRANSFERRING EFFICIENCIES

(75) Inventor: Takeshi Tomizawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/695,003

(22) Filed: Oct. 25, 2000

(30) Foreign Application Priority Data

Oct. 28, 1999 (JP) ..... 11-306901
Oct. 12, 2000 (JP) ..... 2000-311980

(51) Int. Cl.[7] ..... G03G 15/16
(52) U.S. Cl. ..... 399/66; 399/49
(58) Field of Search ..... 399/49, 66, 297, 399/298, 299, 301, 302, 303, 308, 312

(56) References Cited

U.S. PATENT DOCUMENTS 5,294,959 A * 3/1994 Nagao et al. ..... 399/66 X
5,510,885 A * 4/1996 Mori et al. ..... 399/298 X
5,842,080 A * 11/1998 Ashibe et al. ..... 399/49
5,966,561 A * 10/1999 Yamaguchi ..... 399/66
5,978,615 A * 11/1999 Tanaka et al. ..... 399/49
6,091,913 A * 3/2000 Yoshizawa ..... 399/49
6,044,234 A * 7/2000 Suzuki et al. ..... 399/49

FOREIGN PATENT DOCUMENTS

| | | |
|---|---|---|
| EP | 0 851 312 A2 | 7/1998 |
| JP | 57-88466 | 6/1982 |
| JP | 62-218979 | 9/1987 |

* cited by examiner

*Primary Examiner*—Sandra Brase
(74) *Attorney, Agent, or Firm*—Fitzpatrick, Cella, Harper & Scinto

(57) ABSTRACT

An image forming apparatus including an image bearing member for bearing an image, and an intermediate transfer member, wherein a first mode in which the image transferred from the image bearing member to the intermediate transfer member is transferred to a transfer material and a second mode in which the image transferred from the image bearing member to the intermediate transfer member is not transferred to the transfer material are selectable, and wherein the transfer efficiency on transferring the image from the image bearing member to the intermediate transfer member in the second mode is higher than the transfer efficiency on transferring the image from the image bearing member to the intermediate transfer member in the first mode.

40 Claims, 8 Drawing Sheets

IMAGE FORMING APPARATUS WITH SELECTABLE DUAL IMAGE TRANSFERRING MODES HAVING DIFFERENT IMAGE TRANSFERRING EFFICIENCIES

BACKGROUND OF THE INVENTION

1. Field of the Invention

The present invention relates to an image forming apparatus employing an electrophotographic system and, for example, to an image forming apparatus such as a copier, a printer, a facsimile machine and the like.

2. Related Background Art

FIG. 8 is a schematic sectional view of a conventional color image forming apparatus of electrophotographic type employing an intermediate transfer member. In such an image forming apparatus, the step of primarily transferring a toner image formed on a photosensitive member to the intermediate transfer member is repeated for a plurality of color toners, and the toner images on the intermediate transfer member in a secondary transfer step are collectively transferred to a transfer material such as a paper, so that a full color image can be obtained.

Now, an image forming process will be described.

The surface of a photosensitive member 101 as an image bearing member is uniformly charged by a primary charger 107, and an image pattern corresponding to an original image is exposed by a laser exposure apparatus 105 to form an electrostatic latent image on the photosensitive member 101. At the time of developing, a developing bias is applied to the developing sleeves of developing devices 108, 109 to develope the electrostatic latent image on the photosensitive member into a toner image. A transfer bias is applied from a primary transfer roller 106 to an intermediate transfer member 102, and in an primary transfer nip portion, the toner image on the photosensitive member is transferred to the intermediate transfer member 102 by an electric potential difference between the photosensitive member 101 and the intermediate transfer member 102. By repeating a series of the above described steps for four color toners of yellow (Y), magenta (M), cyan(C) and black (K), a full color image is formed wherein toner images of four different colors are superimposed on top of each other on the intermediate transfer member 102. Note that, after the primary transfer, the toner remaining on the photosensitive member is removed by a cleaning blade 110 and collected in a cleaning container.

Next, a secondary transfer belt 103 separated from the intermediate transfer member 102 during a series of the above described steps is brought into pressure contact with the intermediate transfer member 102, and when a paper or the like as a transfer member P' is passed through between the secondary transfer belt 103 and the intermediate transfer member 102, a full color toner image is transferred from the intermediate transfer member 102 to the transfer member. Thereafter, the transfer member is conveyed to a fixing device in which the toner image is subjected to color mixing and at the same time fixed to the transfer member, thereby obtaining a full color image as a permanent image.

The secondary transfer residual toner remaining on the intermediate transfer member 102 is removed by a cleaning member (a blade) 104 and collected in a cleaning container.

However, in the above described configuration, there have been problems as follows.

Since a charged state of the photosensitive member and a charged amount per unit weight of the toner vary with the durability thereof and circumstances, an image density also varies with such a fluctuation. In order to avoid this, the method was employed wherein an image for detection (hereinafter referred to as a patch image) responding to a definite density signal is formed on the photosensitive member and the image density thereof is detected by a sensor and, on the basis of the detected signal, a charging bias inputted to the primary charger 107, an exposure intensity by the exposure device 105 and the charged amount per unit weight of the toner are controlled. There has been known the method wherein the density of the above described patch image is detected on the photosensitive member or transferred to the intermediate transfer member and detected on the intermediate transfer member. Particularly in recent years, in keeping with the miniaturization of the apparatus, it is becoming difficult to obtain a space (a space for installing a sensor) for detecting the density on the photosensitive member and there are many cases where the method for detecting on the intermediate transfer member is adapted. However, in this case, since the density of the patch image formed on the photosensitive member is not directly detected, but detected after it is once transferred to the intermediate transfer member, a transfer efficiency of the patch image should be very high.

A transfer bias (a transfer voltage or a transfer electric current) inputted to the primary transfer roller 106 which is set at the time when a toner image of plural colors is multi-transferred from the photosensitive member to the intermediate transfer member is determined by several conditions. Among them, because a transfer efficiency and a re-transfer rate greatly contribute to density, hue or tone and the like, they are highly valued. FIG. 2 is a graph showing a relationship between a transfer residual rate and a transfer electric current and a relationship between a re-transfer rate and the transfer electric current. The continuous line A represents the transfer residual rate. The broken line B represents the re-transfer rate. As shown in FIG. 2, when the above described transfer electric current is increased, the transfer efficiency (the primary transfer efficiency) is raised (a transfer residual rate A is decreased). However, the re-transfer rate B is also raised. Therefore, at the time when the transfer bias is set, both the transfer efficiency and the re-transfer rate may be preferably optimized.

Note that the transfer efficiency is represented by the proportion of the toner density (the transfer residual rate is represented by the proportion of the transfer residual toner density on the photosensitive member) on the intermediate transfer belt at the time when the sum of the toner density on the intermediate transfer belt subsequent to the primary transfer and the transfer residual toner density on the photosensitive drum is represented by 100. If the toner amount (density) of the toner image formed on the photosensitive member is represented by X and the toner amount (density) of the toner image transferred to the intermediate transfer member with this toner image on the photosensitive member transferred to the intermediate transfer member is represented by Y, the following expression is established:

$$(Y/X)\times 100(\%).$$

Also, the transfer residual rate (which means the rate wherein a toner image is not transferred to the intermediate transfer member but has remaining on the photosensitive member and is contrary to the above described transfer efficiency) is represented by the following expression:

$$\{(X-Y)/X\}\times 100(\%).$$

Also, the re-transfer rate is represented by the proportion of the density of the toner re-transferred to the photosensitive member at the time when the sum of the density of the toner image transferred to the intermediate transfer member and the density of the toner re-transferred (offset) to the photosensitive member when the toner image on the intermediate transfer member passes through the primary transfer portion for the next time is expressed by 100. The re-transfer rate is represented by the following expression if the amount of the toner re-transferred to the photosensitive side is expressed by Z:

$$(Z/Y)\times 100(\%).$$

The above described transfer efficiency, transfer residual rate and re-transfer rate are derived from measuring by densitometer (a product name: 404, manufactured by X-rite Corporation) the density of each toner removed by Mylar tape and attached to CLC80 g/m$^2$ paper adapted by us as the standard paper for color.

However, in the case where a Dmax patch image (the Dmax referred to herein means the maximum density and the Dmax patch means a developed patch image as against the latent image which is Dmax as an image signal) on the photosensitive member used for controlling and adjusting the charged state on the photosensitive member and the charged amount per unit weight of the toner is transferred to the intermediate transfer member and the density of the Dmax patch image is detected on the intermediate transfer member, the transfer bias value set as described above will create problems in the following respects. As the charged amount of the toner per unit weight and the charged state of the photosensitive member suddenly fluctuate according to changes in durability and circumstances, if the weight per unit area (hereinafter referred to as a bearing amount) of the toner image formed on the intermediate transfer member exceeds a predetermined amount (the maximum bearing amount when formed on the transfer member), the transfer bias value set as described above is unable to transfer the Dmax patch image on the photosensitive member sufficiently to the intermediate transfer member, thereby causing a transfer deficiency. In such a state, when the Dmax patch image on the intermediate transfer member is detected by an image density detecting sensor, it is detected lower than the density of the Dmax patch image formed on the photosensitive member and, therefore, it is impossible to adequately control and correct the density of the toner image formed on the photosensitive member. This is because the normal transfer bias value set as described above is set in consideration of not only the transfer efficiency but also re-transferring.

Moreover, in the image forming apparatus wherein the residual toner remaining on the photosensitive member subsequent to the primary transfer is electrostaticly collected by a developing device without being scrubbed and removed by the conventional cleaning blade 110, if the amount of the above described toner residues is high, a phenomenon appearing as a ghost image in the next several cycles of the photosensitive member is developed, thereby causing serious problems. However, the relationship between the transfer residual rate and the transfer bias (the transfer bias applied to the primary transfer roller 106) and the relationship between the re-transfer rate and the transfer bias are, as shown in FIG. 2, in a relationship of trade-off. Therefore, in consideration of the balance between both of them, if the amount of the above described residual toner is set so as to be at the most smallest level as the transfer bias value, the transfer efficiency does not come to the maximum value (the transfer residual rate does not come to the smallest value), and similarly the re-transfer rate does not come to the smallest value.

Also, even in the image forming apparatus wherein the toner image of each color on the photosensitive member is multi-transferred to the transfer member which is borne by a transfer belt as a transfer material bearing member, the problems similar to the above have occurred.

SUMMARY OF THE INVENTION

An object of the present invention is to provide an image forming apparatus capable of preventing the deterioration of the efficiency of transferring the image from the image bearing member to the intermediate transfer member in a second mode.

Another object of the present invention is to provide an image forming apparatus for preventing the deterioration of the efficiency of transferring the image from the image bearing member to the transfer material bearing member in a second mode.

Still another object of the present invention will be apparent by reading the following detailed description.

DESCRIPTION OF THE PREFERRED EMBODIMENTS

Embodiment 1

Figure 1:
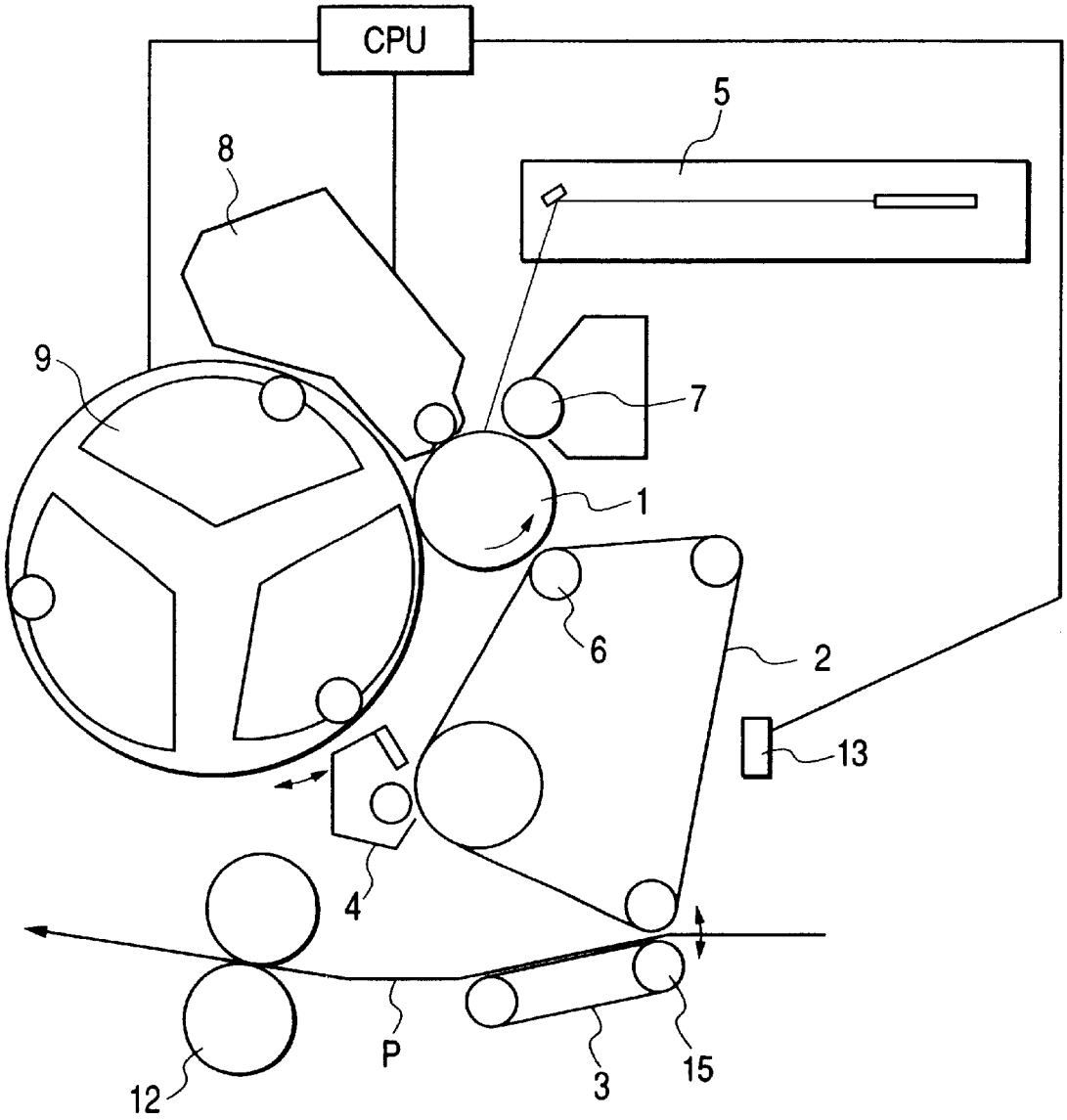
FIG. 1 is a schematic diagram of an image forming apparatus according to the present invention.

FIG. 1 is a schematic sectional view of a color image forming apparatus (such as a copier or a laser printer, etc.) of an electrophotographic system using an intermediate transfer member. This image forming apparatus repeats a step of primarily transferring a toner image formed on a photosensitive member as an image bearing member to an intermediate transfer member for toners of plural colors, and collectively transfer a toner image on the intermediate transfer member to a sheet of paper or the like as a transfer material in a secondary transfer step so that a full color image can be obtained.

Now, an image forming process will be described in detail.

The surface of the photosensitive member 1 is uniformly charged by a primary charger 7 (charged negatively in this embodiment), and subsequently an image pattern based on the original image is exposed by a laser exposing apparatus 5 so that an electrostatic latent image is formed. A developing bias (negative in this embodiment) is applied to a developing sleeve of developing devices 8 (a black developing device), 9 (a yellow developing device, a magenta developing device, and a cyan developing device selectively move to a developing position), the electrostatic latent image on the photosensitive member 1 is developed with a toner and is visualized. A transfer bias (a positive voltage in this embodiment) is applied by the primary transfer roller 6 to an intermediate transfer member 2, and a toner image on the photosensitive member 1 is transferred to the intermediate transfer member 2 at the primary transferring nip portion by the potential difference between the photosensitive member 1 and the intermediate transfer member 2. The above described series of steps are performed for a toner of four colors of yellow (Y), magenta (M), cyan (C) and black (K) so that a full color image is formed in which images with respective four colors are superimposed on top of each other on the intermediate transfer member 2.

In this embodiment, since no conventional cleaning devices such as a cleaning blade, etc. to clean a photosensitive member are provided, the primary transfer residual toner remaining on the photosensitive member 1 after the primary transfer is caused to be attracted to a developing sleeve (to which a negative bias is applied) in an electrostatic manner so that the surface of the photosensitive member is cleaned. Such configuration can be taken so as to give rise to no conventional waste toner, the primary transfer residual toner can be reused for subsequent developing. In addition, if a plurality of transfer materials continuously undergo image forming, the photosensitive member 1 as well as the primary transfer residual toner is charged with the primary charger 7 so that the primary transfer residual toner is attracted to the developing sleeve and concurrently the toner having undergone filming to a thin layer on the developing sleeve is attached (developed) onto an electrostatic latent image having been formed on the photosensitive member 1. At this time, as in the case of ordinary developing, a negative bias is applied to the developing sleeve.

Next, a secondary transfer belt 3 having been kept remote from the intermediate transfer belt 2 at the time of the above described series of steps is brought into pressure contact with the intermediate transfer member 2 and a secondary transfer bias (a positive voltage in this embodiment) is applied to a secondary transfer roller 15 also in charge of stretching the secondary transfer belt so that transfer is performed to a transfer material P to be fed at predetermined timing. The transfer material is conveyed to a fixing device 12 with a secondary transfer belt, and the toner image is fixed onto the transfer material concurrently with color mixing by the fixing device 12 to give rise to a full color image as permanent image.

The secondary transfer residual toner remaining on the intermediate transfer member 2 after the secondary transfer is removed in a cleaning position by a cleaning member 4 (blade) brought into contact with the intermediate transfer member 2 in the counter direction against the moving direction of the intermediate transfer member 2 and collected in a cleaning container.

Next, a density controlling mode will be described that forms a toner image for detection (hereafter to be referred to as a patch image) on the photosensitive member, transfers this onto the intermediate transfer member 2 and detects a density of the patch image transferred onto the intermediate transfer member in order to prevent the density of a toner image formed on the photosensitive member 1 from varying due to variation in endurance or environment. Based on thus detected density, as described later, by putting under control or correcting at least one of a charging bias to be applied to the primary charger, an intensity of exposure by an exposing device 5, a developing bias to be applied to a developing sleeve, a supplying motion to supply the developing device with a toner (determination whether or not it should be supplied, or a control to vary the amount of toner supplied to the developing device and adjust the ratio of toner to carrier in the developing devices 8 and 9 to maintain a charging amount per unit weight of toner constant), the density of the toner image to be formed onto the photosensitive member 1 can be arranged always to become proper.

This embodiment is configured by transferring once the patch image formed on the photosensitive member to the intermediate transfer member, and detecting a density of the patch image by a density detecting sensor 13 as detecting means since there is no room to reserve space for a sensor to be disposed between the developing portion and the primary transfer portion due to reduction in size of the photosensitive member. Since such configuration might give rise to a difference in density between a patch image on the photosensitive member and a patch image on the intermediate transfer member, it is preferable that the primary transfer efficiency of a patch image from the photosensitive member to the intermediate transfer member (hereinafter to be referred to as transfer efficiency) is caused to get closer to 100% as much as possible.

Figure 2:
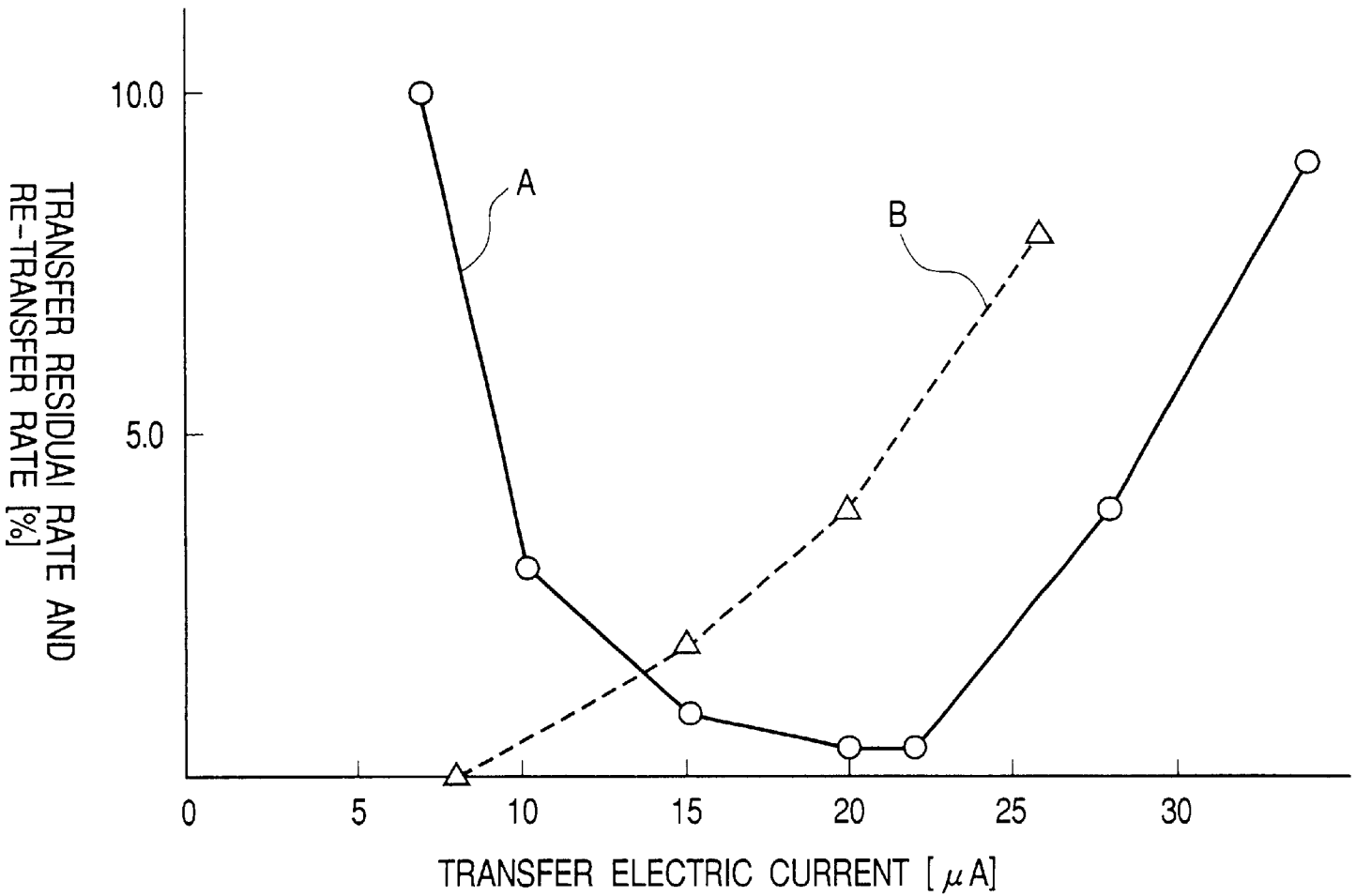
FIG. 2 is a graph showing a relationship between a transfer residual rate and a transfer electric current and a relation ship between a re-transfer rate and the transfer electric current.

FIG. 2 shows a relationship of a transfer residual rate and a re-transfer rate under temperature of 23° C. and relative humidity of 60%. Transfer efficiency, transfer residual rate and re-transfer rate will be described again in detail.

Transfer efficiency is to represent a percentage of toner density on the intermediate transfer belt if the sum of a toner density on the intermediate transfer belt after the primary transfer and a density of transfer residual toner is regarded as 100 (whereas, transfer residual rate is a percentage of transfer residual toner density on the photosensitive member). With X being a toner amount (density) of a toner image formed onto the photosensitive member and Y being a toner amount (density) of a toner image that has been transferred to the intermediate transfer member subject to transfer of this toner image on the photosensitive member onto the intermediate transfer member, it is given by:

$$(Y/X)\times 100(\%)$$

In addition, transfer residual rate (that means ratio of residues having remained on the photosensitive member due to transfer failure of the toner image onto the intermediate transfer member, and runs counter to the above described transfer efficiency) is given by:

$$\{(X-Y)/X\}\times 100(\%)$$

In addition, re-transfer rate is to represent a percentage of density of the toner re-transferred onto the photosensitive member if the sum of a density of the toner image transferred onto the intermediate transfer member and a density of the toner re-transferred (offset) onto the photosensitive member when a toner image on the intermediate transfer member passes through the primary transfer portion for the next time is regarded as 100. With Z being a toner amount having been re-transferred (offset) onto the photosensitive member side, it is given by:

$$(Z/Y)\times 100(\%)$$

As for the above described transfer efficiency, transfer residual rate and re-transfer rate were respectively obtained by being measured with a densitometer (product name: 404, manufactured by X-rite Corporation) subject to the toner being separated with Mylar tape which was attached to a sheet of CLC 80 g/m$^2$ paper adopted by the assignee as standard paper for coloring. In addition, a patch image is sized to be a square of 25 mm×25 mm.

If the toner image in each color is sequentially superimposed and transferred from the photosensitive member to the intermediate transfer member for forming an image onto the transfer material, due to necessity that the toner image in each color must undergo multi-transfer without discrimination, a transfer bias value thereof is preferably, as described above, set to be at such a value that makes the transfer residual rate and the re-transfer rate together small as much as possible.

Figure 3:
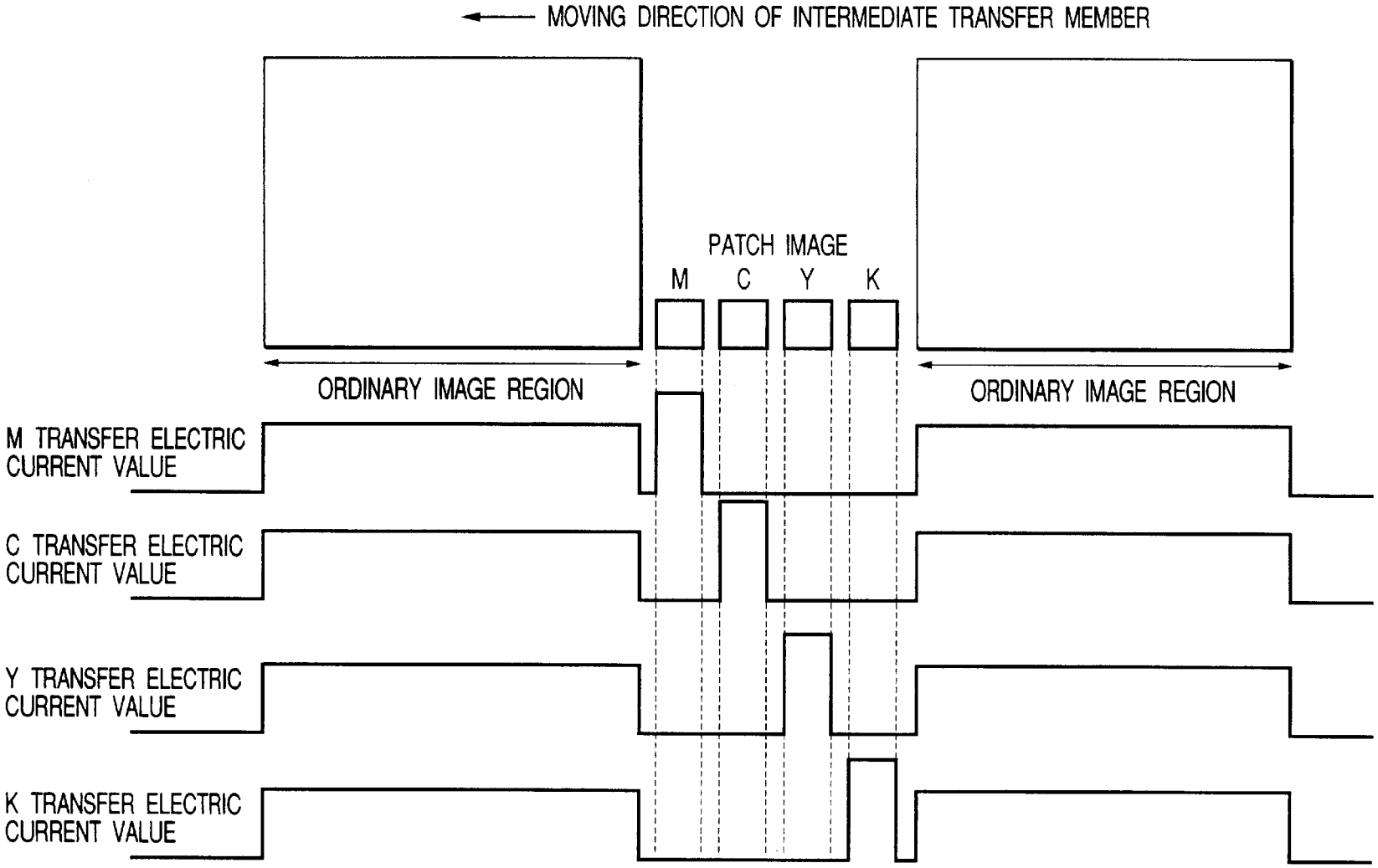
FIG. 3 is a schematic diagram showing set statuses of respective transfer electric current values.

Incidentally, in the case of transferring a patch image from the photosensitive member onto the intermediate transfer member, without forming (transferring) an image on the transfer material, and detecting this with a sensor 13 and thereafter cleaning this with a cleaning device 4, there is a limitation that approximately 100% of the patch image formed on the photosensitive member must be transferred. In addition, since the patch image is not transferred to be superimposed on top of each other to the intermediate transfer member together with images in other colors, the transfer bias value is preferably set so that, when the patch image is transferred from the photosensitive member to the intermediate transfer member, the transfer efficiency increases and when the ordinary image is transferred from the photosensitive member to the intermediate transfer member by sequentially superimposing toner images in respective colors, the transfer efficiency is made smaller than that at the time of the above described patch image transfer, considering balancing between the both of transfer efficiency (transfer residual rate) and re-transfer rate (FIG. 3).

Figure 4:
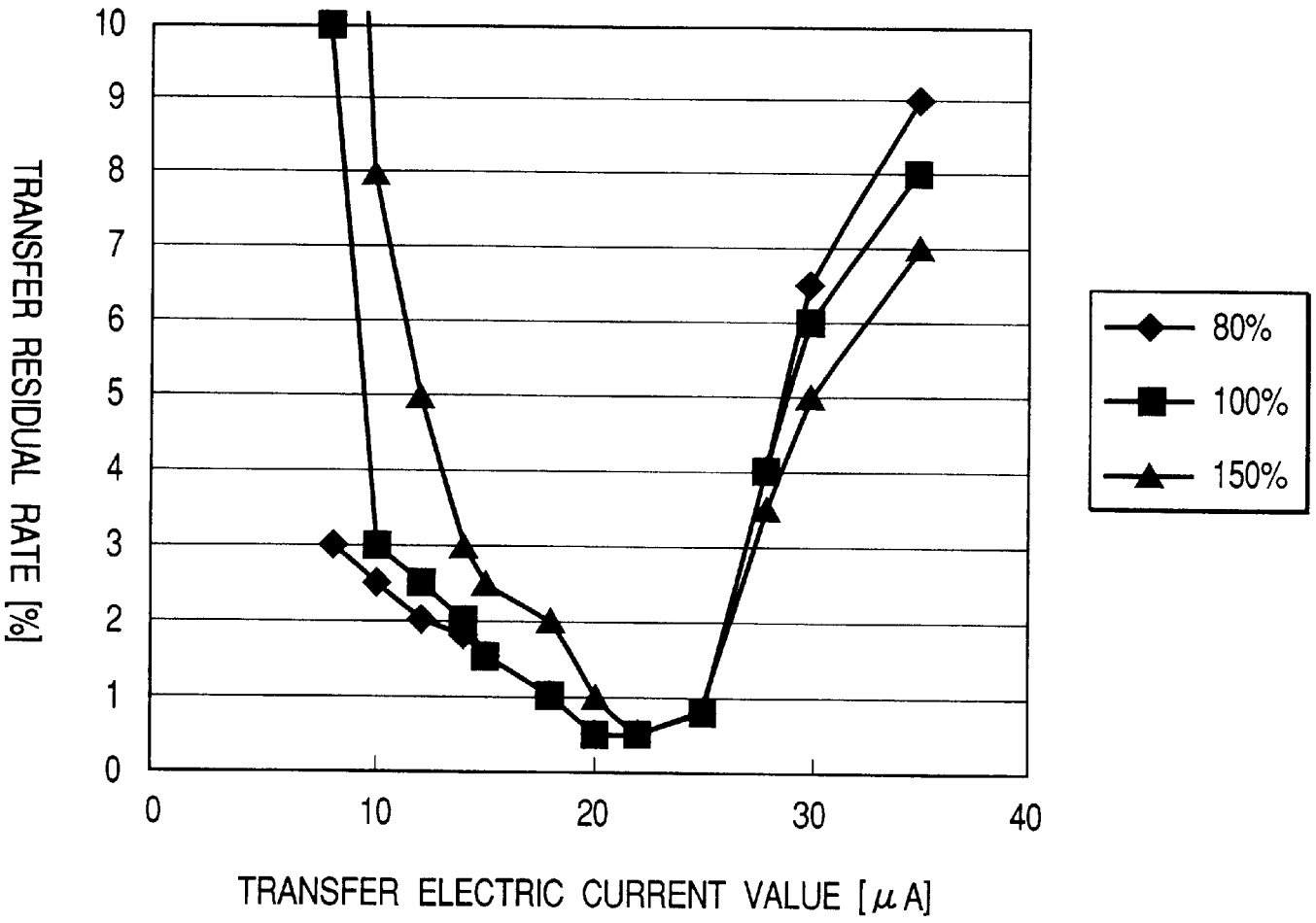
FIG. 4 is a graph showing the transfer residual rate versus the transfer electric current value.

FIG. 4 is a graph showing a relationship between transfer electric current and transfer residual rate if the toner amount (toner bearing amount) per unit area of a toner image formed on the photosensitive member is caused to increase. As apparent from this FIG. 4, it goes well in order to realize a low transfer residual rate (a high transfer efficiency) when a toner amount per unit area (toner density) (being 100% when it is the same as the maximum bearing amount) increases if a transfer electric current value is set larger than a transfer electric current value (14 $\mu$A) when a toner image is transferred from the photosensitive member onto the intermediate transfer member in order to form an image on a transfer material. Accordingly, in order to detect the density of the Dmax patch image having been formed onto the above described photosensitive member with a sensor subject to transfer onto the intermediate transfer member, it is preferable that a supposed transfer electric current is set presuming also the case where density of the Dmax patch image (toner bearing amount) gets larger.

In this embodiment, a transfer bias value to be applied to the primary transfer roller 6 was set so that the transfer residual rate would be less than 2% when the toner bearing amount 150% (9 g/m$^2$) of the maximum bearing amount (6 g/m$^2$) of the toner transferred onto the transfer material.

That is, in this embodiment, under the environment with temperature of 23° C. and relative humidity of 60%, based on FIG. 2, the primary transfer electric current value was set at 14 $\mu$A in the case (the first mode) where the toner image is transferred from the photosensitive member to the intermediate transfer member in order to form an image (patch image) onto the transfer material, the patch image undergoes transfer from the photosensitive member onto the intermediate transfer member so that the sensor 13 proceeds with detection, and thereafter the primary transfer electric current value was set at 20 $\mu$A in the case (the second mode) where without forming (transferring) any image onto the transfer material this is cleaned with the cleaning device 4. It goes without saying that transfer charge density given in the primary transfer portion for the image formed on the transfer material is substantially meant to be different from that for the image for controlling and not formed on the transfer material, and the transfer charge density of the latter will get larger than the transfer charge density of the former since the necessary primary transfer electric current value almost remains the same despite of size of the patch image.

In this embodiment, since the secondary transfer belt is kept remote from the intermediate transfer member except during the period when the secondary transfer is performed on the transfer material, the secondary transfer belt can prevent from getting dirty due to the patch image. In addition, as secondary transferring means, a corona charger which is opposed to the intermediate transfer member in a facing noncontact fashion and a roller charger that can be brought into contact with and made apart from the intermediate transfer member may be used.

In this embodiment, based on density of the patch image detected as described above, by controlling and correcting at least one of a charging bias to be applied to the primary charger, an intensity of exposure by an exposing device 5, a developing bias to be applied to a developing sleeve, a supplying motion to supply the developing device with a toner (determination whether or not it should be supplied, or a control to vary the amount of toner supplied to the developing device and adjust ratio between toner and carrier in the developing devices 8 and 9 to maintain a charging amount per unit weight of toner to a constant), the density of the toner image to be formed onto the photosensitive member 1 can be arranged always to become proper. In addition, besides this, a detection result of the sensor may be controlled and corrected by feeding back the transfer bias that is applied to the primary transfer roller 6 and the transfer bias that is applied to the secondary transfer roller.

Moreover, in this embodiment, the case where a constant electric current power source was adopted as the primary transfer power source to apply a voltage to the primary transfer roller 6 has been described, but the present invention can be likewise applied to the case where a constant voltage power source is adopted.

That is, if the constant voltage power source is adopted, it will go well if the primary transfer voltage value in the case (the second mode) where the patch image undergoes transfer from the photosensitive member onto the intermediate transfer member so that the sensor 13 proceeds with detection, and thereafter without forming (transferring) any image onto the transfer material this is cleaned with the cleaning device 4 set at a value larger than the primary transfer voltage value in the case (the first mode) where the toner image is transferred from the photosensitive member to the intermediate transfer member in order to form an image (patch image) on the transfer material so as to consequently give rise to a large-and-small relationship on the transfer electric current value as in the above described embodiment.

Setting the primary transfer electric current value being set like this, the transfer efficiency of the patch image from a photosensitive member to an intermediate transfer member can be made larger than the transfer efficiency of the toner image from the photosensitive member to the intermediate transfer member for ordinary image forming so that correction of the density of a toner image formed on the photosensitive member can be done well.

Incidentally, in order to obtain transfer efficiency, the same toner image (latent image) is used in the above described first mode and second mode so that density is detected.

In addition, since this embodiment is an image forming apparatus that does not comprise any cleaning member in such a photosensitive member as described in FIG. 1, limiting transfer residual/re-transfer rate more strictly, and thus by taking the configuration of this embodiment, that effect can be attained more sufficiently.

Embodiment 2

Figure 5:
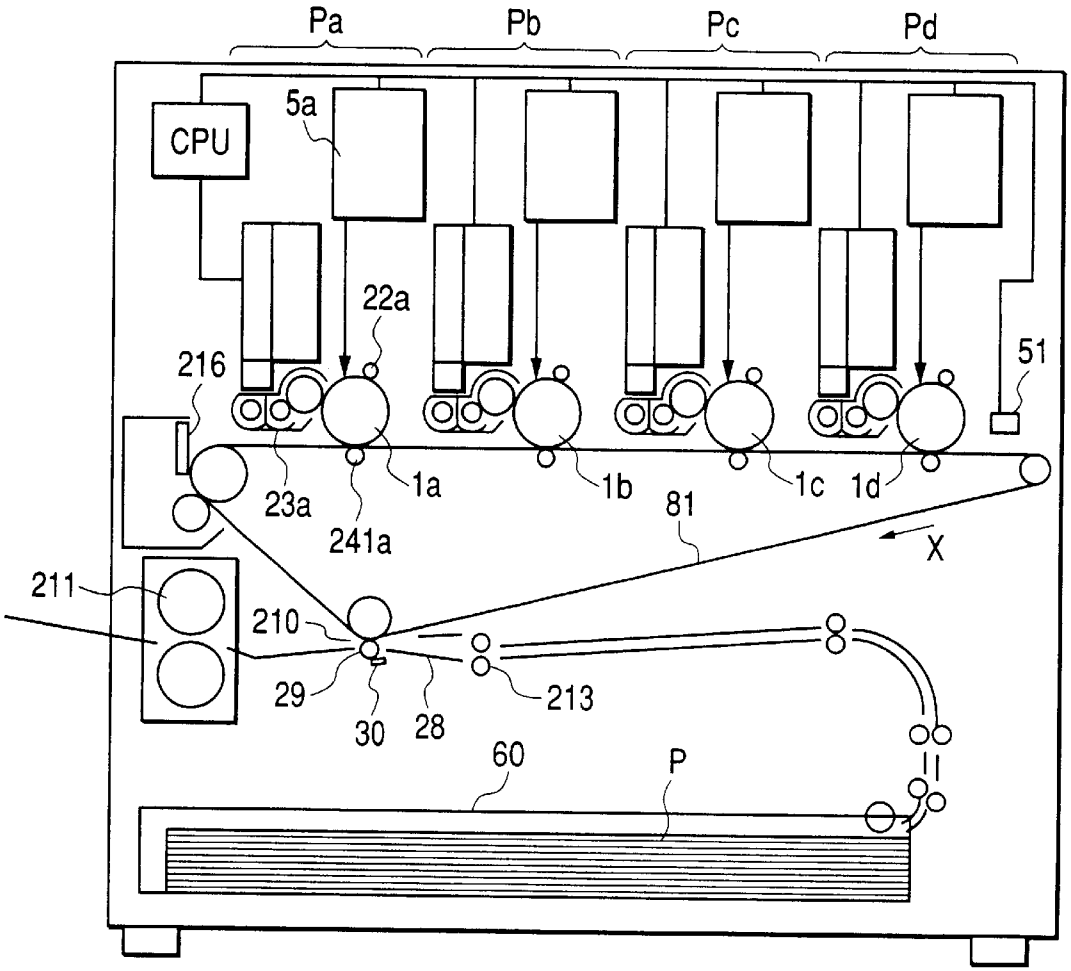
FIG. 5 is a schematic diagram of the image forming apparatus according to the present invention.

FIG. 5 is a schematic view showing an image forming apparatus to describe an embodiment 2 of the present invention. The image forming process and functions of respective members, etc. in this image forming apparatus are almost the same as those described in the embodiment 1. The point significantly different from the embodiment 1 is that the image forming apparatus of this embodiment is provided with four photosensitive members. The image forming process will be briefly described as follows.

Inside the main body of the image forming apparatus, an intermediate transfer belt 81 is disposed as an endless intermediate transfer member that runs in the arrowed direction of X. This intermediate transfer belt 81 is configured by dielectric resin such as polycarbonate, polyethylene terephthalate resin film, and polyvinyliden fluoride resin film, etc. A transfer material P taken out from a sheet feed cassette 60 is conveyed to a secondary transfer portion via a conveying system including a registration roller 213.

Above the intermediate transfer belt 81, four image forming sections Pa, Pb, Pc and Pd configured in the almost same way as in the embodiment 1 are disposed tandem. That configuration will be described by taking the image forming section Pa as example. The image forming section Pa comprises a drum-shaped electrophotographic photosensitive member (hereinafter referred to as "photosensitive member") 1*a* as an image bearing member that is rotationally disposed. In the periphery of the photosensitive member 1*a*, process devices such as a primary charger 22*a* and a developing device 23*a*, etc. are disposed. Other image forming sections Pb, Pc and Pd are provided with a configuration like the image forming section Pa, and FIG. 5 only illustrates the photosensitive members 1*b*, 1*c* and 1*d* respectively. These image forming sections 1*a*, 1*b*, 1*c* and 1*d* are different in a point that they respectively form toner images in colors of magenta, cyan, yellow and black.

Developing devices disposed in respective image forming sections contain a magenta toner, a cyan toner, a yellow toner and a black toner.

In the image forming section Pa, from an exposing apparatus 5*a* as exposing means such as a polygon mirror, etc. to the photosensitive member 1*a* charged with a charging roller 22*a* as charging means, image exposure with a magenta component color of the original image is performed so that an electrostatic latent image is formed, and from a developing device 23*a* (developing sleeve) as developing means to the electrostatic latent image the magenta toner is supplied so that the electrostatic latent image becomes a magenta toner image. When this toner image is moved with rotation of the photosensitive member 1*a* to arrive at a primary transfer section where the photosensitive member 1*a* and the intermediate transfer member 81 are in contact with each other, the above described magenta toner image undergoes primary transfer onto the intermediate transfer member 81 with a primary transfer bias that is applied to the primary transfer roller 241*a* as transfer means. When an intermediate transfer member 81 bearing the magenta toner image is conveyed to a primary transfer section of the image forming section Pb, by this time, in the image forming section Pb, a cyan toner image formed on the photosensitive member 1*b* with a method similar to the image formation in the the image formation section Pa undergoes primary transfer onto the above described magenta toner image in a superimposed fashion.

Likewise, as the intermediate transfer member 81 goes ahead to the primary transfer sections of the image forming sections Pc and Pd, in the respective primary transfer sections, after the yellow toner image and the black toner image are sequentially superimposed and transferred to the above described toner image, by this time, the transfer material P taken out from the sheet feed cassette 60 reaches the secondary transfer portion so that the above described four color toner images collectively undergo secondary transfer with the secondary transfer bias applied to the secondary transfer roller 29.

Thereafter, the transfer material 6 is conveyed to the fixing apparatus 211 (fixing roller pair). In the fixing portion, a step to fuse and bond the toner image onto the transfer material with heat and pressure is performed. Moreover, in order to improve the mold releasing nature between the transfer material P and the fixing roller, the fixing portion has a mechanism to proceed with coating on the surface of the fixing roller with the mold releasing oil (for example, silicone oil, etc.) so that this oil is also attached onto the transfer material. The transfer material on which a toner image is fixed undergoes sheet discharging to a sheet discharging tray. But when the two-sided image is automatically formed, the transfer material is passed through a transfer material surface reversing path (not shown) and contained in a cassette for two-sided copying, thereafter the transfer material is again fed to the secondary transfer portion in order that images are formed on the two sides of the transfer material.

Subsequently to the primary transfer, the primary transfer residual toner remaining on the photosensitive member 1*a* is collected to the developing device 23*a* in an electrostatic manner. In addition, if images are formed in a consecutive manner onto a plurality of transfer materials, the developing device is configured to collect the primary transfer residual toner on the photosensitive members as well as to concurrently develop latent images on the photosensitive members.

Subsequently to the secondary transfer, the secondary transfer residual toner remaining on the intermediate transfer belt 81 is removed by a cleaning device 216 (blade) contacting the intermediate transfer member for removal and collected into the cleaning container. In the cleaning position, the above described blade is configured to incline to the upstream side in the moving direction of the intermediate transfer member so as to be brought into contact with the intermediate transfer member in a counter direction.

Also in this embodiment, as strictly already described in the embodiment 1, the transfer electric current value (charge density) to be applied to the primary transfer roller provided in the respective primary transfer portions is set so that the primary transfer residual toner as well as the re-transfer toner will be made minimum.

Next, described will be a density controlling mode that forms toner images (hereinafter referred to as patch images) for detection on the respective photosensitive members, transfers the patch images onto the intermediate transfer member 81 respectively and detects densities of the patch images in respective colors transferred onto the intermediate transfer member in order to prevent densities of the toner images formed onto the respective photosensitive members from varying due to variation in endurance or environment. Based on thus detected densities, with the CPU as control means putting under control or correcting at least one of charging biases to be applied to the respective primary charging apparatuses, intensities of exposure by respective exposing devices, developing biases to be applied to respective developing sleeves, supplying motions to supply the developing devices with toners (determination whether or not it should be supplied, or a control to vary the amount of toner supplied to the developing device and adjust ratio between toner and carrier in the developing devices to maintain a charging amount per unit weight of toner constant), the densities of the toner images to be formed onto the respective photosensitive members can be arranged always to become proper.

This embodiment is configured by transferring once the patch image formed on the photosensitive member to the intermediate transfer member, and detecting a density of the patch image with a density detecting sensor 51 as detecting means since there is no room to reserve space for a sensor to be disposed between the developing portion and the primary transfer portion due to reduction in size of the photosensitive member. Since such configuration might give rise to a difference between a density of a patch image on the photosensitive member and a density of a patch image on the intermediate transfer member, it is preferable that the primary transfer efficiency of a patch image from the photosensitive member to the intermediate transfer member (hereinafter referred to as a transfer efficiency) is as close to 100% as possible.

As in the above described embodiment 1, due to necessity that the toner image in each color must undergo multi-transfer to the intermediate transfer member without discrimination, a primary transfer bias value thereof must be set to be at such a value that makes the transfer residual rate and the re-transfer rate together small as much as possible.

FIG. 3 is a graph showing a status of each primary transfer bias value being set in view hereof. That is, FIG. 3 shows a case where a patch image in each color is formed between ordinary image regions where ordinary images are formed on the intermediate transfer member. In the primary transfer portion of the image forming section Pa, when a patch image in magenta color is transferred, the primary transfer electric current value is set at a value larger than if an ordinary magenta color image is transferred, but in the primary transfer portions of image forming sections Pb, Pc and Pd located downstream of this image forming section Pa, electric current values to be applied to the primary transfer rollers (disposed beneath the image forming sections Pb, Pc and Pd) is set at a value smaller than if ordinary cyan, yellow and black color images are transferred. In addition, likewise, in the primary transfer portion of the image forming section Pb, when a patch image in cyan color is transferred, the primary transfer electric current value is set at a value larger than a value at which an ordinary cyan color image is transferred, but in the primary transfer portions of image forming sections Pc and Pd located downstream of this image forming section Pb, electric current values to be applied to the primary transfer rollers (disposed beneath the image forming sections Pc and Pd) is set at a value smaller than a value at which ordinary yellow and black color images are transferred. The above described processing will be applied to the patch image in yellow color as well as to the patch image in black color, too.

Setting thus the electric current value to be applied to each primary transfer roller causes the patch image in each color to undergo exact primary transfer onto the intermediate transfer belt, and in the primary transfer portion in the subsequent image forming section, without being re-transferred onto the photosensitive member, to be conveyed to detecting means 51 provided downstream of the image forming section Pd in the moving direction of the intermediate transfer member.

In this embodiment, since the secondary transfer roller is kept remote from the intermediate transfer belt except at the time of the second transfer, the secondary transfer roller can prevent from getting dirty due to the patch image in each color. In addition, secondary transferring means may be a corona charger which is disposed out of contact with the intermediate transfer member and a blade or belt charger that is disposed in contact with the intermediate transfer member.

In addition, this embodiment has been described with reference to an example in which based on the results of density detection on the patch images the density of a toner image formed onto the photosensitive member is controlled, but is not limited thereto.

For example, the present invention can be applied to a color misregister control mode to control timing (timing to start exposure in the moving direction of the photosensitive member (sub-scanning direction) and/or the direction perpendicular to the moving direction (main scanning direction)) when to start exposure onto each photosensitive member with each exposing apparatus by forming a patch image in each color from each photosensitive member onto the intermediate transfer member as shown in FIG. 3 and detecting the relative position (the moving direction of the intermediate transfer member as well as the direction perpendicular to the moving direction) of each color patch image with the sensor (CCD) 51, and based on the result of this detection (a relative positional misregister amount between a patch image and another patch image as well as a result of comparison of an interval of time period for a passage of each patch image with a predetermined value). Such a color misregister control mode is executed so that a toner image can be superimposed accurately from each photosensitive member to the intermediate transfer member and color misregistered image can be prevented from being formed. Incidentally, the density control mode or the color misregister control mode is preferably performed for each image formation onto a predetermined number of sheets of transfer material. As concerns the density control mode, due to a case where environments could cause the density to vary, the CPU may judge, based on the results of detection on the environment (temperature and humidity), whether or not the above described mode should be executed.

As having been described so far, an image forming apparatus that has a plurality of photosensitive members and detects the patch image in each color on the intermediate transfer member can implement accurate density control as well as color misregister control as in the embodiment 1. In addition, single detecting means 51 can detect the patch image in each color, thus resulting in cost reduction. In addition, even with a configuration (the patch image is removed from the intermediate transfer member with the cleaning device 216) in which the cleaning device 216 of the intermediate transfer member is provided downstream of the secondary transfer portion in the moving direction of the intermediate transfer member, the patch image can be prevented from being attached onto the secondary transfer roller.

In addition, also in this embodiment, since this embodiment is configured by comprising no conventional cleaning members for the photosensitive member, color mixing could take place due to a toner in another color being mixed into inside the developing device, but taking the configuration of this embodiment to reduce transfer residual rate and re-transfer rate, that effect can be attained more sufficiently.

Embodiment 3

Figure 6:
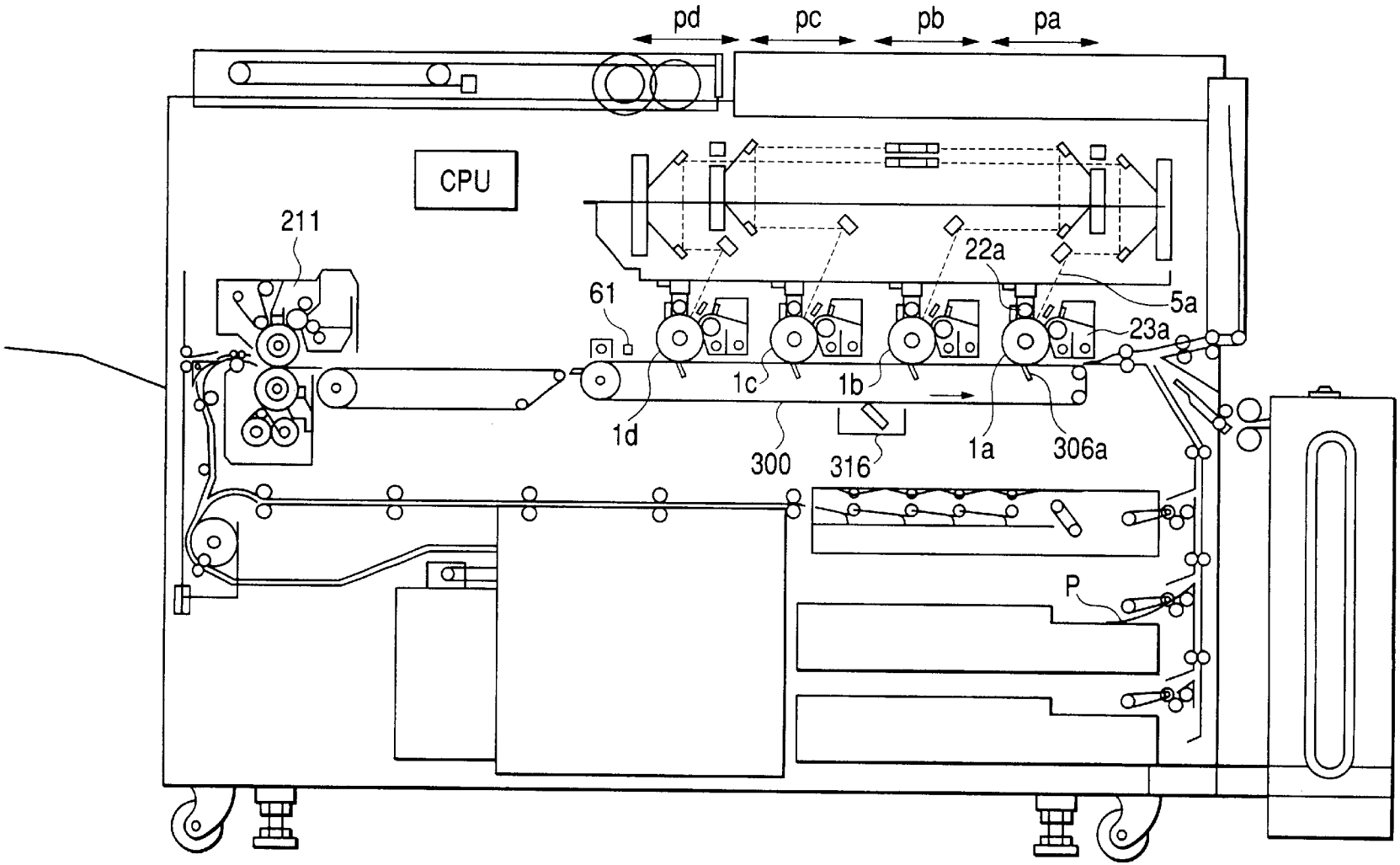
FIG. 6 is a schematic diagram of the image forming apparatus describing the third embodiment of the present invention.

FIG. 6 is a schematic view showing an image forming apparatus to describe an embodiment 3 of the present invention. Configuration of the image forming apparatus shown in FIG. 6 is almost the same as those in the embodiment 1 and 2 except those points described as follows. That is, in this embodiment, an image formation is performed by sequentially transferring and superimposing toner images in respective colors from respective photosensitive members onto transfer material P borne and conveyed by the transfer belt 300 as a transfer material bearing member, and this point is the point significantly different from the embodiments 1 and 2. The image forming process will be briefly described as follows.

Above the transfer belt 300, four image forming sections Pa, Pb, Pc and Pd configured almost the same as in the embodiments 1 and 2 are disposed in tandem. That configuration will be described by taking the image forming section Pa as example. The image forming section Pa comprises a drum-shaped electrophotographic photosensitive member (hereinafter referred to as "photosensitive member") 1*a* as an image bearing member that is rotationally disposed. In the periphery of the photosensitive member 1*a*, process devices such as a primary charger 22*a* and a developing device 23*a*, etc. are disposed. Other image forming sections Pb, Pc and Pd are provided with a configuration like the image forming section Pa, and the above described FIG. 6 indicates references numerals only to the photosensitive members 1*b*, 1*c* and 1*d* respectively. These image forming sections 1*a*, 1*b*, 1*c* and 1*d* are different in a point that they respectively form toner image in each color of magenta, cyan, yellow and black.

Developing devices disposed in respective image forming sections contain a magenta toner, a cyan toner, a yellow toner and a black toner.

In the image forming section Pa, from an exposing device 5*a* as exposing means such as semiconductor laser and a polygon mirror, etc. to the photosensitive member 1*a* charged with a charging roller 22*a* as charging means, an image exposure with a magenta component color of the original image is performed so that an electrostatic latent image is formed, and from a developing device 23*a* (developing sleeve) as developing means to the electrostatic latent image the magenta toner is supplied so that the electrostatic latent image becomes a magenta toner image. When this toner image is moved with rotation of the photosensitive member 1*a* to arrive at a transfer portion where the photosensitive member 1*a* and the transfer belt 300 are brought into contact with each other, the above described magenta toner image is transferred onto the transfer material P borne on the transfer belt with a transfer bias that is applied to the transfer blade 306*a* as transfer means. When a transfer material bearing a magenta toner image on the transfer belt is conveyed to the transfer portion of the image forming section Pb, by this time, in the image forming section Pb, a cyan toner image formed on the photosensitive member 1*b* with a method similar to the image formation in the image forming section Pa is transferred onto the above described magenta toner image in a superimposed fashion.

Likewise, as the transfer material on the transfer belt goes ahead to the transfer portions of the image forming sections Pc and Pd, in the respective transfer portions, after the yellow toner image and the black toner image are sequentially superimposed and transferred to the above described toner image.

Thereafter, the transfer material 6 is separated from the transfer belt and is conveyed to the fixing device 211 (fixing roller pair). In the fixing portion, a step to fuse and bond the toner image onto the transfer material with heat and pressure is performed. Moreover, in order to improve the mold releasing nature between the transfer material P and the fixing roller, the fixing portion has a mechanism to proceed with coating on the surface of the fixing roller with the mold releasing oil (for example, silicone oil, etc.) so that this oil is also attached onto the transfer material. The transfer material on which a toner image is fixed undergoes sheet discharging to a sheet discharging tray. But when the two-sided image is automatically formed, the transfer material is passed through a transfer material surface reversing path (not shown) and contained in a cassette for two-sided copying and again fed to the transfer portion in order to form an image on the other surface of the transfer material.

Subsequently to the transfer, the transfer residual toner remaining on the photosensitive member 1*a* is collected to the developing device 23*a* in an electrostatic manner. In addition, if images are formed in a consecutive manner onto a plurality of transfer materials, the developing device is configured to collect the transfer residual toner on the photosensitive members simultaneously with developing latent images on the photosensitive members.

Subsequently to the transfer material being separated, the foreign matter on the transfer belt is removed by a cleaning device 316 (blade) contacting the transfer belt for removing the foreign matter and is collected into the cleaning container. In the cleaning position, the above described blade is configured to be inclined to the upstream side in the moving direction of the transfer belt so as to be brought into counter contact with the transfer belt.

Also in this embodiment, as in the above described embodiments 1 and 2, the electric current value (charge density) to be applied to each transfer blade 306 as transfer means is set so that the transfer residual toner and the re-transfer toner will be made minimum.

Next, described will be a density controlling mode that forms toner images (hereinafter referred to as patch images) for detection on the respective photosensitive members, transfers the patch images directly onto the transfer belt respectively and detects densities of the patch images in respective colors transferred onto the transfer belt in order to prevent densities of toner images formed onto the respective photosensitive members from varying due to variation in endurance or environment. Based on thus detected densities, with the CPU as control means putting under control and correcting at least one of a charging bias to be applied to the respective primary chargers, intensities of exposure by respective exposing devices, developing biases to be applied to respective developing sleeves, supplying motions to supply the developing devices with toners (determination whether or not it should be supplied, or a control to vary the amount of toner supplied to the developing devices and adjust ratio between toner and carrier in the developing devices to maintain a charging amount per unit weight of toner constant), the densities of the toner images to be formed onto the respective photosensitive members can be arranged always to become proper.

This embodiment is configured by transferring once the patch image formed on the photosensitive member to the transfer belt, and detecting the patch image with a density detecting sensor 61 as detecting means since there is no room to reserve space for a sensor to be disposed between the developing portion and the transfer portion due to reduction in size of the photosensitive member. Since such configuration might give rise to a difference between a density of a patch image on the photosensitive member and a density of a patch image on the transfer belt, it is preferable that the transfer efficiency of a patch image from the photosensitive member to the transfer belt is as close to 100% as much as possible.

If toner images are sequentially transferred and superimposed on a transfer material borne by a transfer belt in an ordinary way, as in the above described embodiments 1 and 2, due to necessity that the toner image in each color must undergo multi-transfer without discrimination, the electrical current value to be applied to each transfer blade is preferably made so that the transfer residual rate and the re-transfer rate together will be made small as much as possible.

That is, in this embodiment, in the transfer portion of the image forming section Pa, when a patch image in magenta color is transferred, the transfer electric current value is set at a value larger than a value at which an ordinary magenta color image is transferred, but in the transfer portions of the image forming sections Pb, Pc and Pd located downstream of the image forming section Pa, electric current values to be applied to the transfer blades (disposed beneath the image forming sections Pb, Pc and Pd) is set at a value smaller than a value at which ordinary cyan, yellow and black color images are transferred (this embodiment is applicable as is when the moving direction of the intermediate transfer member is replaced with the moving direction of the transfer belt, and the ordinary image region is replaced with the transfer material bearing region in FIG. 3). In addition, likewise, in the transfer portion of the image forming section Pb, when a patch image in cyan color is transferred, the transfer electric current value is set at a value larger than a value at which an ordinary cyan color image is transferred, but in the transfer portion of the image forming sections Pc and Pd located downstream of the image forming section Pb, electric current values to be applied to the transfer blades (disposed beneath the image forming sections Pc and Pd) is set at a value smaller than a value at which ordinary yellow and black color images are transferred. The above described processing will be applied to the patch image in yellow color as well as to the patch image in black color, too.

Setting thus the electric current value to be applied to each transfer blade causes the patch image in each color to undergo exact transfer onto the transfer belt, and in the transfer portion in the subsequent image forming section, without being re-transferred onto the photosensitive member, to be conveyed to detecting means 61 provided downstream of the image forming section Pd in the moving direction of the transfer belt.

In addition, this embodiment has been described with reference to an example in which based on the results of density detection on the patch images the density of a toner image formed onto the photosensitive member is controlled, but is not limited thereto.

For example, the present invention can be applied to a color misregister control mode to control timing (timing to start exposure in the moving direction of the photosensitive member (sub-scanning direction) and/or the direction perpendicular to the moving direction (main scanning direction)) when to start exposure onto each photosensitive member with each exposing apparatus by forming a patch image in each color from each photosensitive member onto the transfer belt as shown in FIG. 3 and detecting the relative position (the moving direction of the transfer belt and the direction perpendicular to the moving direction) with the sensor (CCD) 61, and based on the result of this detection (a relative positional misregister amount between a patch image and another patch image or a result of comparison of an interval of time period for passage of each patch image with a predetermined value). Such a color misregister control mode is executed so that a toner image can be superimposed accurately from each photosensitive member to the transfer material borne on the transfer belt and a color misregistered image can be prevented from being formed. Incidentally, the density control mode or the color misregister control mode is preferably performed for each image formation onto a predetermined number of sheets of transfer material. As concerns the density control mode, due to a case where environments could cause the density to vary, the CPU may judge, based on the results of detection on the environment (temperature and humidity), whether or not the above described mode should be executed.

As having been described so far, by maximizing transfer efficiency of patch image in each color directly transferred to the transfer belt without being transferred onto the transfer material in the image forming apparatus which implement multi-transfer directly onto the transfer material and moreover minimizing the re-transfer rate to re-transfer the patch image in each color to the photosensitive member side in the other transfer portions, density control mode and color misregister control mode can be performed exactly. In addition, as in the above described second embodiment, since only one detecting means 61 can detect the patch image in each color, cost reduction can be performed.

In addition, also since this embodiment is configured by comprising no conventional cleaning members for the photosensitive member, color mixing could take place due to a toner in another color being mixed into inside the developing device, but taking the configuration of this embodiment to reduce the transfer residual rate and the re-transfer rate, that effect can be attained more sufficiently.

Embodiment 4

This embodiment adopts a plate-shaped blade brought into counter contact as cleaning apparatus of an intermediate transfer belt or a transfer belt in the embodiments 1 to 3, and in order to prevent the cleaning blade from turning over (being worked up) due to endurance, etc. increasing friction between the intermediate transfer belt and the cleaning blade, has a supply mode to supply the contact portions between the cleaning blade and the intermediate transfer belt or the transfer belt with a belt toner (a toner image in magenta color) at predetermined timing without undergoing transfer onto the transfer material. Taking such a configuration, with toner functioning as a lubricant agent in the above described contact portions (sliding portions), the cleaning blade can be prevented from being turned over.

Also in such a supply mode, in case of an image forming apparatus having no cleaning mechanism for the photosensitive member, it must be avoided that this toner will have been left on the photosensitive member as transfer residual/re-transfer toner.

In the gap between sheets, at time of initial rotation or post-rotation of an image formation, solid image is formed on the photosensitive member all over in the direction of thrust and with 5 mm width in the sub-scanning direction, and transferred onto the intermediate transfer member (transfer material bearing member) to be supplied to the above described sliding portion.

Figure 7:
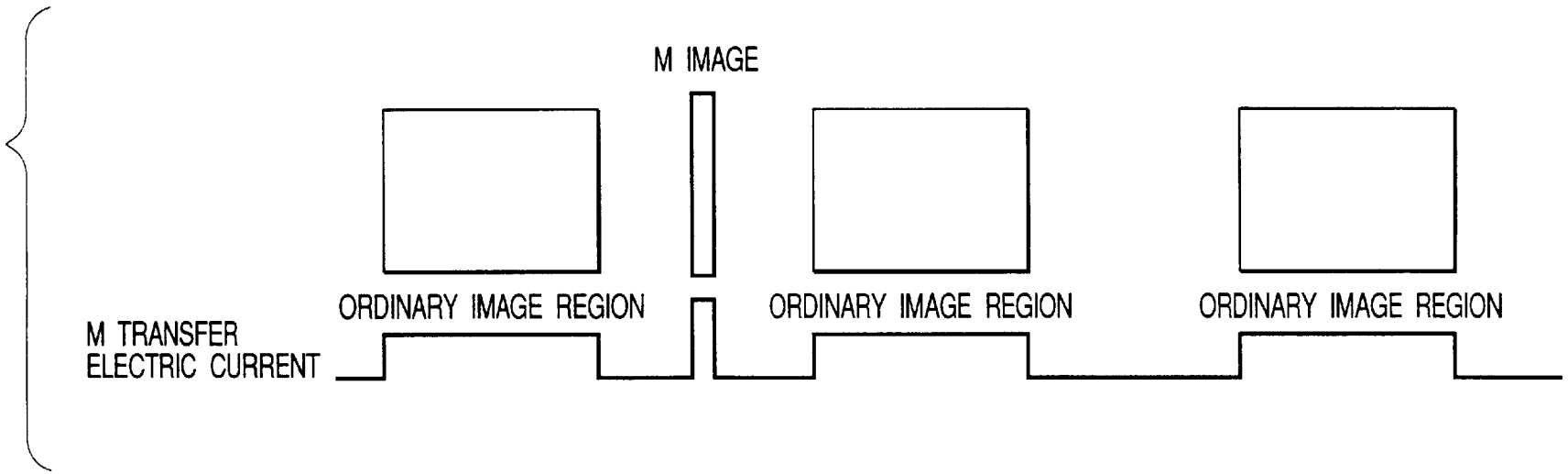
FIG. 7 is a schematic diagram showing a set status of the transfer electric current value for a belt image (a solid belt image)
Figure 8:
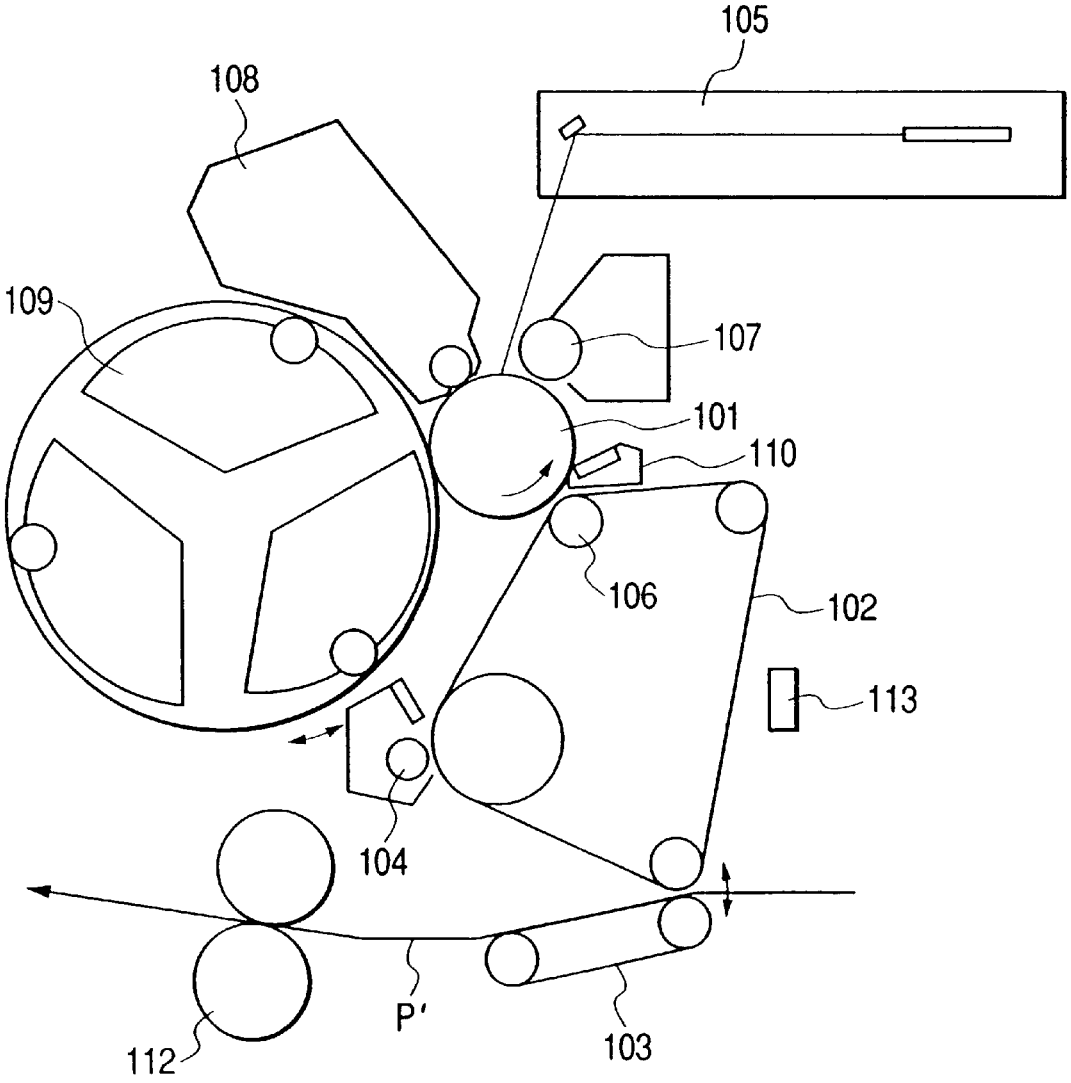
FIG. 8 PRIOR ART
FIG. 8 is a schematic diagram of the conventional image forming apparatus.

Under the circumstances, as shown in FIG. 7, the electric current value to be applied to the primary transfer roller in the case (the first mode) where the belt toner image in magenta color is transferred from the photosensitive member to the intermediate transfer member in the supply mode is set at a value larger than a value in the case (the second mode) where the toner image in ordinary magenta color is transferred from the photosensitive member onto the intermediate transfer member in order to form an image in the transfer material. Setting like this, the transfer efficiency of the belt toner image from a photosensitive member to an intermediate transfer member can be made larger than the transfer efficiency of the toner image in ordinary magenta color from a photosensitive member to the intermediate transfer member. Accordingly, the toner remaining on the photosensitive member can be held to a minimum (minimum in transfer residual rate).

As having been described above, this processing can be applied to an image forming apparatus as shown in the embodiment 3 having a transfer belt.

In addition, in the above described embodiments 1 to 4, in order to make the transfer efficiency of the patch image in the second mode larger than the transfer efficiency of the ordinary image in the first mode, the transfer bias was switched, but the method is not limited thereto, and the object is attainable by switching difference in peripheral speed between the peripheral speed of the photosensitive member and the peripheral speed of the intermediate transfer member (peripheral speed of the transfer material bearing member) in the transfer portion. That is, it goes well if the difference in the above described peripheral speed in the second mode is made larger than the difference in the peripheral speed in the first mode. Incidentally, the above described difference in peripheral speed in the first mode may be set at zero. In addition, at the time of transfer, the peripheral speed of the photosensitive member is preferably set faster than the peripheral speed of the intermediate transfer member or the transfer material bearing member since it makes such an effect larger that causes the toner image on the photosensitive member to be scraped off by the intermediate transfer member or the transfer material bearing member (since the transfer residual rate can be made small). In addition, in order to minimize the re-transfer rate, it goes well if the methods having been described in the above described embodiments 1 to 4 are adopted.

Incidentally, in the above described embodiments 1 to 4, if transfer efficiencies are compared, it shall be performed by forming the same latent image onto the photosensitive member, developing the latent image to treat as patch toner image (that is, forming a toner image with the same density in the both of the first and second modes), and transferring the patch toner image onto the intermediate transfer member or the transfer material bearing member. In addition, in the embodiment 3, if transfer efficiency is given when the first mode is selected, the transfer material to be borne on the transfer belt shall be a sheet of CLC 80 g/m$^2$ paper adopted by the assignee as standard paper for coloring. Moreover, if the transfer efficiencies are compared, it shall be performed when environment, that is, temperature and humidity inside the apparatus is the same in the both of the first mode and the second mode.

What is claimed is:

1. An image forming apparatus comprising:

an image bearing member for bearing an image; and an intermediate transfer member, wherein a first mode for transferring an image transferred from said image bearing member to said intermediate transfer member to a transfer material and a second mode not for transferring the image transferred from said image bearing member to said intermediate transfer member to the transfer material are selectable; and wherein a transfer efficiency on transferring the image from said image bearing member to said intermediate transfer member in said second mode is higher than a transfer efficiency on transferring the image from said image bearing member to said intermediate transfer member in said first mode.

2. The image forming apparatus according to claim 1, further comprising electric current applying means for applying an electric current to said intermediate transfer member so as to transfer the image on said image bearing member to said intermediate transfer member, wherein an absolute value of the electric current applied to said intermediate transfer member by said electric current applying means in said second mode is larger than an absolute value of the electric current applied to said intermediate transfer member by said electric current applying means in said first mode.

3. The image forming apparatus according to claim 1, wherein a difference between a peripheral speed of said image bearing member and a peripheral speed of said intermediate transfer member in said second mode is larger than a difference between a peripheral speed of said image bearing member and a peripheral speed of said intermediate transfer member in said first mode.

4. The image forming apparatus according to any one of claims 1 to 3, further comprising detection means for detecting a density of the image transferred from said image bearing member to said intermediate transfer member in said second mode and control means for controlling a density of a toner image formed on said image bearing member in said first mode based on a detection result of said detection means.

5. The image forming apparatus according to claim 4, further comprising a plurality of image bearing members, wherein images of a plurality of colors are sequentially transferred and superimposed on top of each other from said plurality of image bearing members to said intermediate transfer member in said first mode and the images of a plurality of colors on said intermediate transfer member are transferred to the transfer material.

6. The image forming apparatus according to claim 5, wherein the images of a plurality of colors are transferred from said plurality of image bearing members to said intermediate transfer member so as not to be superimposed on top of each other in said second mode.

7. The image forming apparatus according to claim 6, wherein said electric current applying means comprises:

first electric current applying means for applying an electric current to said intermediate transfer member for transferring an image on a first image bearing member to said intermediate transfer member in a first transfer position; and second electric current applying means for applying an electric current to said intermediate transfer member for transferring an image on a second image bearing member disposed downstream of said first image bearing member in a movement direction of said intermediate transfer member to said intermediate transfer member in a second transfer position, wherein an absolute value of the electric current applied from said second electric current applying means to said intermediate transfer member when the image transferred from said first image bearing member to said intermediate transfer member passes through said second transfer position in said second mode is smaller than an absolute value of the electric current applied from said second electric current applying means to said intermediate transfer member when the image on said second image bearing member is transferred to said intermediate transfer member in said first mode.

8. The image forming apparatus according to claim 7, wherein when the image transferred from said first image bearing member to said intermediate transfer member passes through said second transfer position in said second mode, the electric current applied from said second electric current applying means to said intermediate transfer member is substantially zero.

9. The image forming apparatus according to any one of claims 1 to 3, wherein images of a plurality of colors are sequentially transferred and superimposed on top of each other from said image bearing member to said intermediate transfer member and the images of a plurality of colors on said intermediate transfer member are transferred to the transfer material.

10. The image forming apparatus according to claims 1 to 3, further comprising a plurality of image bearing members, wherein images of a plurality of colors are sequentially transferred and superimposed on top of each other from said plurality of image bearing members to said intermediate transfer member in said first mode and the images of a plurality of colors on said intermediate transfer member are transferred to the transfer material.

11. The image forming apparatus according to claim 10, wherein the images of a plurality of colors are transferred from said plurality of image bearing members to said intermediate transfer member so as not to be superimposed on top of each other in said second mode.

12. The image forming apparatus according to claim 11, further comprising:

detection means for detecting positions of the images of a plurality of colors transferred to said intermediate transfer member in said second mode; and control means for controlling a timing for starting a formation of the image on each of said plurality of image bearing members based on a detection result of said detection means.

13. The image forming apparatus according to claim 12, wherein said electric current applying means comprises:

first electric current applying means for applying an electric current to said intermediate transfer member for transferring an image on a first image bearing member to said intermediate transfer member in a first transfer position; and second electric current applying means for applying an electric current to said intermediate transfer member for transferring an image on a second image bearing member disposed downstream of said first image bearing member in a movement direction of said intermediate transfer member to said intermediate transfer member in a second transfer position, wherein an absolute value of the electric current applied from said second electric current applying means to said intermediate transfer member when the image transferred from said first image bearing member to said intermediate transfer member passes through said second transfer position in said second mode is smaller than an absolute value of the electric current applied from said second electric current applying means to said intermediate transfer member when the image on said second image bearing member is transferred to said intermediate transfer member in said first mode.

14. The image forming apparatus according to claim 13, wherein when the image transferred from said first image bearing member to said intermediate transfer member passes through said second transfer position in said second mode, the electric current applied from said second electric current applying means to said intermediate transfer member is substantially zero.

15. The image forming apparatus according to any one of claims 1 to 3, further comprising a blade abutting against said intermediate transfer member in an abutment position for removing toner on said intermediate transfer member, wherein the image transferred from said image bearing member to said intermediate transfer member is supplied to said abutment position in said second mode.

16. The image forming apparatus according to claim 15, further comprising a plurality of image bearing members, wherein images of a plurality of colors are sequentially transferred and superimposed on top of each other from said plurality of image bearing members to said intermediate transfer member in said first mode and the images of a plurality of colors on said intermediate transfer member are transferred to the transfer material.

17. The image forming apparatus according to claim 16, wherein the images of a plurality of colors are transferred from said plurality of image bearing members to said intermediate transfer member so as not to be superimposed on top of each other in said second mode.

18. The image forming apparatus according to claim 17, wherein said electric current applying means comprises:

first electric current applying means for applying an electric current to said intermediate transfer member for transferring an image on a first image bearing member to said intermediate transfer member in a first transfer position; and second electric current applying means for applying an electric current to said intermediate transfer member for transferring an image on a second image bearing member disposed downstream of said first image bearing member in a movement direction of said intermediate transfer member to said intermediate transfer member in a second transfer position, wherein an absolute value of the electric current applied from said second electric current applying means to said intermediate transfer member when the image transferred from said first image bearing member to said intermediate transfer member passes through said second transfer position in said second mode is smaller than an absolute value of the electric current applied from said second electric current applying means to said intermediate transfer member when the image on said second image bearing member is transferred to said intermediate transfer member in said first mode.

19. The image forming apparatus according to claim 18, wherein when the image transferred from said first image bearing member to said intermediate transfer member passes through said second transfer position in said second mode, the electric current applied from said second electric current applying means to said intermediate transfer member is substantially zero.

20. The image forming apparatus according to any one of claims 1 to 3, further comprising developing means for developing a latent image formed on said image bearing member with a developer, wherein said developing means collects the developer remaining on said image bearing member after the image is transferred from said image bearing member to said intermediate transfer member.

21. An image forming apparatus comprising:

an image bearing member for bearing an image; and a transfer material bearing member for bearing a transfer material, wherein a first mode for transferring the image from said image bearing member to the transfer material borne by said transfer material bearing member and a second mode for transferring the image from said image bearing member to said transfer material bearing member are selectable, and wherein a transfer efficiency on transferring the image from said image bearing member to said transfer material bearing member in said second mode is higher than a transfer efficiency on transferring the image from said image bearing member to the transfer material in said first mode.

22. The image forming apparatus according to claim 21, further comprising an electric current applying means for applying the electric current to said transfer material bearing member for transferring the image on said image bearing member to the transfer material borne by said transfer material bearing member or to said transfer material bearing member, wherein an absolute value of the electric current applied to said transfer material bearing member by said electric current applying means in said second mode is larger than an absolute value of the electric current applied to said transfer material bearing member by said electric current applying means in said first mode.

23. The image forming apparatus according to claim 21, wherein a difference between a peripheral speed of said image bearing member and a peripheral speed of said transfer material bearing member in said second mode is larger than a difference between a peripheral speed of said image bearing member and a peripheral speed of said transfer material bearing member in said first mode.

24. The image forming apparatus according to any one of claims 21 to 23, further comprising:

detection means for detecting a density of the image transferred from said image bearing member to said transfer material bearing member in said second mode; and control means for controlling a density of a toner image formed on said image bearing member in said first mode based on a detection result of said detection means.

25. The image forming apparatus according to claim 24, further comprising a plurality of image bearing members, wherein images of a plurality of colors are sequentially transferred and superimposed on top of each other from said plurality of image bearing members to said transfer material bearing member in said first mode.

26. The image forming apparatus according to claim 25, wherein the images of a plurality of colors are transferred from said plurality of image bearing members to said transfer material bearing member so as not to be superimposed on top of each other in said second mode.

27. The image forming apparatus according to claim 26, further comprising:

first electric current applying means for applying an electric current to said transfer material bearing member for transferring an image on a first image bearing member to the transfer material borne by said transfer material bearing member or to said transfer material bearing member in a first transfer position; and second electric current applying means for applying an electric current to said transfer material bearing member for transferring an image on a second image bearing member disposed downstream of said first image bearing member in a movement direction of said transfer material bearing member to the transfer material borne by said transfer material bearing member or to said transfer material bearing member in a second transfer position;

wherein an absolute value of the electric current applied from said second electric current applying means to said transfer material bearing member when the image transferred from said first image bearing member to said transfer material bearing member passes through said second transfer position in said second mode is smaller than an absolute value of the electric current applied from said second electric current applying means to said transfer material bearing member when the image on said second image bearing member is transferred to the transfer material borne by said transfer material bearing member in said first mode.

28. The image forming apparatus according to claim 27, wherein when the image transferred from said first image bearing member to said transfer material bearing member passes trough said second transfer position in said second mode, the electric current applied from said second electric current applying means to said transfer material bearing member is substantially zero.

29. The image forming apparatus according to any one of claims 21 to 23, wherein images of a plurality of colors are sequentially transferred and superimposed on top of each other from said image bearing member to the transfer material borne by said transfer material bearing member in said first mode.

30. The image forming apparatus according to any one of claims 21 to 23, further comprising a plurality of image bearing members, wherein images of a plurality of colors are sequentially transferred and superimposed on top of each other from said plurality of image bearing members to said transfer material bearing member in said first mode.

31. The image forming apparatus according to claim 30, wherein the images of a plurality of colors are transferred from said plurality of image bearing members to said transfer material bearing member so as not to be superimposed on top of each other in said second mode.

32. The image forming apparatus according to claim 31, further comprising:

detection means for detecting positions of the images of a plurality of colors transferred to said transfer material bearing member in said second mode; and control means for controlling a timing for starting a formation of the image on each of said plurality of image bearing members based on a detection result of said detection means.

33. The image forming apparatus according to claim 32, wherein said electric current applying means comprises:

first electric current applying means for applying an electric current to said transfer material bearing member for transferring an image on a first image bearing member to the transfer material borne by said transfer material bearing member or to said transfer material bearing member in a first transfer position; and second electric current applying means for applying an electric current to said transfer material bearing member for transferring an image on a second image bearing member disposed downstream of said first image bearing member in a movement direction of said transfer material bearing member to the transfer material borne by said transfer material bearing member or to said transfer material bearing member in a second transfer position, wherein an absolute value of the electric current applied from said second electric current applying means to said transfer material bearing member when the image transferred from said first image bearing member to said transfer material bearing member passes through said second transfer position in said second mode is smaller than an absolute value of the electric current applied from said second electric current applying means to said transfer material bearing member when the image on said second image bearing member is transferred to the transfer material borne by said transfer material bearing member in said first mode.

34. The image forming apparatus according to claim 33, wherein when the image transferred from said first image bearing member to said transfer material bearing member passes trough said second transfer position in said second mode, the electric current applied from said second electric current applying means to said transfer material bearing member is substantially zero.

35. The image forming apparatus according to any one of claims 21 to 23, further comprising a blade abutting against said transfer material bearing member in an abutment position for removing toner on said transfer material bearing member, wherein the image transferred from said image bearing member to said transfer material bearing member is supplied to said abutment position in said second mode.

36. The image forming apparatus according to claim 35, further comprising a plurality of image bearing members, wherein images of a plurality of colors are sequentially transferred and superimposed on top of each other from said plurality of image bearing members to said transfer material bearing member in said first mode.

37. The image forming apparatus according to claim 36, wherein the images of a plurality of colors are transferred from said plurality of image bearing members to said transfer material bearing member so as not to be superimposed on top of each other in said second mode.

38. The image forming apparatus according to claim 37, wherein said electric current applying means comprises:

first electric current applying means for applying an electric current to said transfer material bearing member for transferring an image on a first image bearing member to the transfer material borne by said transfer material bearing member or to said transfer material bearing member in a first transfer position; and second electric current applying means for applying an electric current to said transfer material bearing member for transferring an image on a second image bearing member disposed downstream of said first image bearing member in a movement direction of said transfer material bearing member to the transfer material borne by said transfer material bearing member or to said transfer material bearing member in a second transfer position;

wherein an absolute value of the electric current applied from said second electric current applying means to said transfer material bearing member when the image transferred from said first image bearing member to said transfer material bearing member passes through said second transfer position in said second mode is smaller than an absolute value of the electric current applied from said second electric current applying means to said transfer material bearing member when the image on said second image bearing member is transferred to the transfer material borne by said transfer material bearing member in said first mode.

39. The image forming apparatus according to claim 38, wherein when the image transferred from said first image bearing member to said transfer material bearing member passes trough said second transfer position in said second mode, the electric current applied from said second electric current applying means to said transfer material bearing member is substantially zero.

40. The image forming apparatus according to any one of claims 21 to 23, further comprising developing means for developing a latent image formed on said image bearing member with a developer, wherein said developing means collects the developer remaining on said image bearing member after the image is transferred from said image bearing member to the transfer material borne by said transfer material bearing member or to said transfer material bearing member.

* * * * *